US012584360B2

(12) United States Patent
Zhang

(10) Patent No.: US 12,584,360 B2
(45) Date of Patent: Mar. 24, 2026

(54) SONDE CENTRALIZATION INSIDE A COLLAR

(71) Applicant: Halliburton Energy Services, Inc., Houston, TX (US)

(72) Inventor: Lizheng Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/782,251

(22) Filed: Jul. 24, 2024

(65) Prior Publication Data

US 2026/0028885 A1 Jan. 29, 2026

(51) Int. Cl.
*E21B 17/10* (2006.01)
*E21B 47/01* (2012.01)

(52) U.S. Cl.
CPC ..... *E21B 17/1007* (2013.01); *E21B 47/01* (2013.01)

(58) Field of Classification Search
CPC .. E21B 17/1078; E21B 17/10; E21B 17/1028; E21B 17/1014; E21B 47/107
See application file for complete search history.

(56) References Cited

U.S. PATENT DOCUMENTS 2,680,488 A * 6/1954 Atkinson ..... E21B 17/1028 166/241.7
3,356,147 A * 12/1967 Dreyfuss ..... E21B 17/1028 166/241.7
3,528,499 A 9/1970 Collett
3,929,388 A 12/1975 Sutko et al.
5,803,127 A * 9/1998 Rains ..... F16L 7/00 138/148
6,516,877 B2 2/2003 Terry
7,048,064 B1 5/2006 Smith
9,523,246 B2 12/2016 Logan et al.
(Continued)

FOREIGN PATENT DOCUMENTS

CA 2890615 C 2/2019

OTHER PUBLICATIONS

International Search Report and Written Opinion for International Patent Application No. PCT/US2025/021826 dated Jul. 11, 2025. PDF file. 10 pages.

*Primary Examiner* — Kipp C Wallace
(74) *Attorney, Agent, or Firm* — Benjamin Ford; C. Tumey Law Group PLLC

(57) ABSTRACT

A system may include a centralizer configured to be disposed in a radial gap formed between a downhole tubular and a sonde housing. The centralizer may include at least one support feature having a first circumferential end feature, a second circumferential end feature, and an elongated body portion extending axially along a centralizer axis and extending circumferentially about the centralizer axis from the first circumferential end feature to the second circumferential end feature. The elongated body portion may be corrugated with radially inward extending portions and radially outward extending portions alternating along the elongated body portion. Additionally, the radially inward extending portions may be configured to contact the sonde housing and the radially outward extending portions may be configured to contact the downhole tubular to hold the sonde housing in a centralized position with respect to the downhole tubular.

9 Claims, 9 Drawing Sheets

(56) References Cited

U.S. PATENT DOCUMENTS

| | | | | |
|---|---|---|---|---|
| 10,167,683 | B2 | 1/2019 | Logan et al. | |
| 10,352,111 | B2 | 7/2019 | Logan et al. | |
| 10,358,906 | B2 | 7/2019 | Logan et al. | |
| 10,598,000 | B2 * | 3/2020 | Liu | E21B 17/1078 |
| 10,871,041 | B2 | 12/2020 | Logan et al. | |
| 11,873,687 | B2 | 1/2024 | Zhang et al. | |
| 11,873,688 | B2 | 1/2024 | Zhang et al. | |
| 11,933,115 | B2 | 3/2024 | Zhang et al. | |
| 11,933,116 | B2 | 3/2024 | Zhang et al. | |
| 11,988,050 | B2 | 5/2024 | Zhang et al. | |
| 2008/0083645 | A1 | 4/2008 | Cravatte | |

* cited by examiner

SONDE CENTRALIZATION INSIDE A COLLAR

BACKGROUND

Downhole logging tools are generally used during downhole drilling operations and/or production operations to determine physical, chemical, and structural properties of a downhole formation about a borehole. Generally, downhole logging tools such as logging-while-drilling (LWD) tool, measuring-while-drilling (MWD) tools, or some combination thereof, may be placed within a drill string and/or a downhole tool, which are run-in-hole during operations. These tools may include electronic systems such as electrical circuits and sensors to perform specific tasks.

During drilling operations and/or production operations, the operating environment experienced by the downhole logging tools may be harsh. For example, as set forth above, the downhole logging tool may be disposed in a drill string such that the downhole logging tool may experience relatively high forces caused by vibration of the drill bit cutting through the downhole formations. Further, the downhole logging tools may also experience temperatures far exceeding surface temperatures. The temperature and vibration experienced may exceed the specified ranges for some of the components (e.g., electrical components) of the downhole logging tools.

Accordingly, the electrical components may be disposed within a protective housing (e.g., a sonde housing) to protect the electrical components from such downhole conditions. The sonde (e.g., the electrical components and sonde housing) may be positioned within a downhole tubular such as the drill string tubular or a collar of a downhole tool.

Further, to ensure proper functioning of the sonde, it may be necessary to stabilize the sonde in a specific location or orientation with respect to the borehole and/or the downhole tubular. Generally, the sonde must be positioned along a central axis of the downhole tubular or the borehole to ensure proper functioning. Alternatively, having the sonde stabilized within the downhole tubular in a position radially offset from the central axis of the downhole tubular or the borehole may ensure proper functioning. A centralizer may be used to support the sonde with the downhole tubular. Unfortunately, centralizers with tight tolerances to minimize movement of the centralizer with respect to the downhole tubular may be difficult and/or costly to manufacture and install between the sonde and the downhole tubular.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for stabilizing a sonde housing within a downhole tubular and, more particularly, example embodiments may include a centralizer having at least one support feature configured to stabilize the sonde housing with respect to the downhole tubular. The at least one support feature may be disposed within a radial gap formed between the sonde housing and the downhole tubular. The at least one support feature is configured to contact the radially inner surface of the downhole tubular, as well as the radially outer surface of the sonde housing to stabilize the sonde housing (e.g., hold the sonde housing in a desired position with respect to the downhole tubular). The at least one support feature may be corrugated to permit fluid flow through the downhole tubular with the at least one support feature installed. Further, as set forth in greater detail below, the at least one support feature may only extend partially about the circumference of the sonde housing, which may permit increased deflection of the centralizer, which may improve case of installation of the centralizer.

Figure 1:
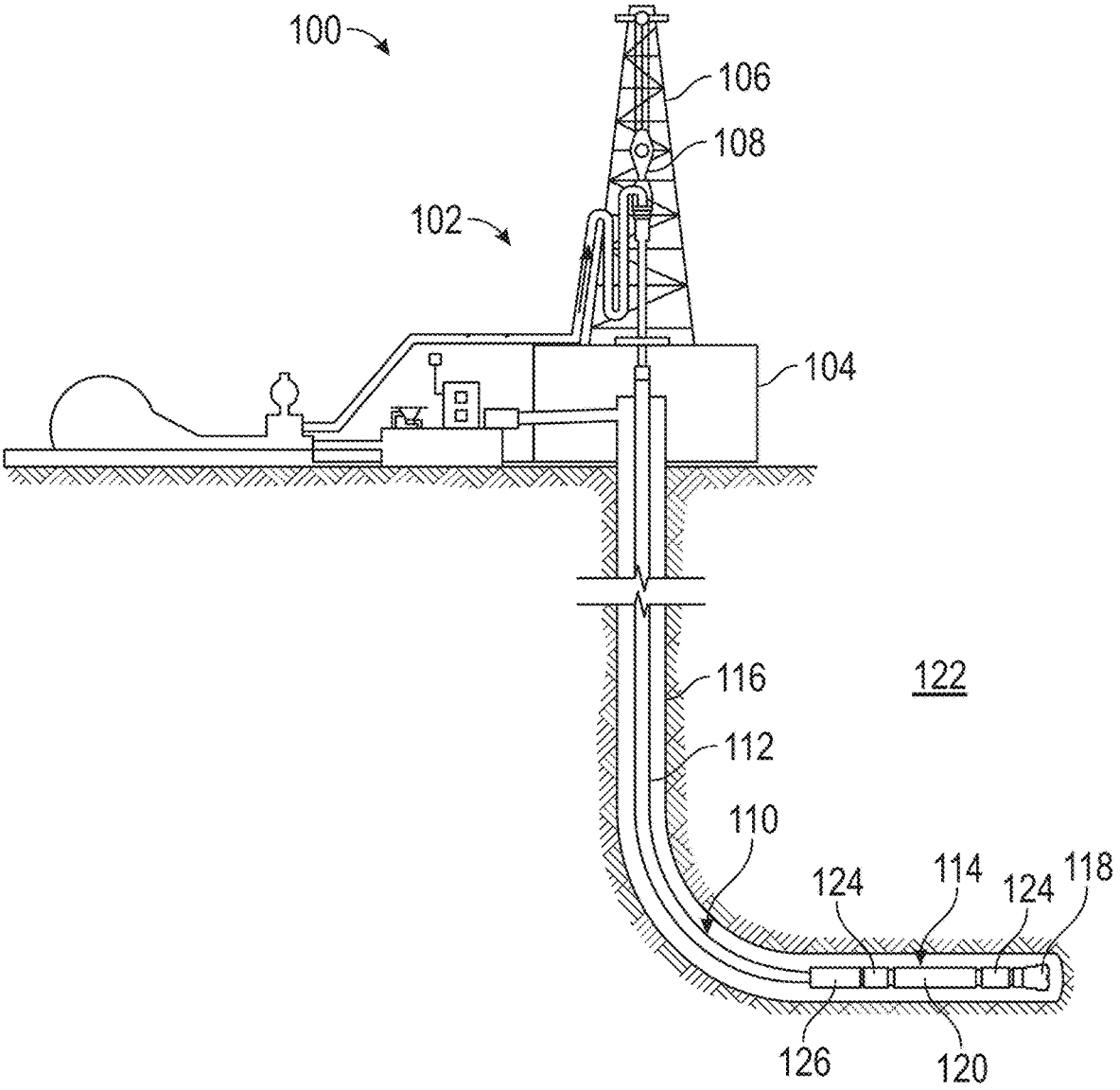
FIG. 1 illustrates an elevation view of a well system, in accordance with some embodiments of the present disclosure.

FIG. 1 illustrates an elevation view of a well system, in accordance with some embodiments of the present disclosure. As illustrated, the well system 100 may include drilling assembly 102. However, the well system 100 may alternatively be configured to production operations. Further, it should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 102 includes a drilling platform 104 that supports a derrick 106 having a traveling block 108 for raising and lowering a downhole tubular 110 (e.g., a drill string 112). The downhole tubular 110 includes, but is not limited to, drill pipe, a bottom hole assembly 114, and any other suitable downhole tools, as generally known to those skilled in the art. While not shown, coiled tubing may be used instead of convention drill pipe for supporting the bottom hole assembly 114 in a borehole 116. The bottom hole assembly 114 includes a drill bit 118. The bottom hole assembly 114 may also include a mud motor system 120 configured to drive rotation of the drill bit 118. As the drill bit 118 rotates, it may penetrate various subterranean formations 122 to create the borehole 116.

At least one downhole logging tool 124 (e.g., a logging-while-drilling (LWD) tool, measuring while-drilling (MWD) tool, etc.) may be disposed within the bottom hole assembly 114. For example, at least one downhole logging tool 124 may be coupled just above the drill bit 118. Alternatively, or additionally, the at least one downhole logging tool 124 may be disposed in the mud motor system 120, in the drill string above the mud motor system 120, in a downhole tool separate from the bottom hole assembly 114, or in any other suitable location for drilling and/or production operations. The at least one downhole logging tool 124 may be configured to determine physical, chemical, and structural properties of the borehole 116 and/or the subterranean formations 122 about the borehole 116.

Further, the at least one downhole logging tool 124 may include an electronics system packaged within at least one sonde 202 (shown in FIG. 2) and positioned within the downhole tubular 110 (e.g., the drill string 112, the bottom hole assembly 114, etc.). Moreover, the bottom hole assembly 114 may further comprise a communication subsystem with a telemetry module 126. The telemetry module 126 may also include an electronics system configured to be packaged within the at least one sonde 202 and positioned within a portion of the downhole tubular 110 (e.g., a drill collar) that forms an outer housing of the telemetry module 126. The least one sonde may include a plurality of sondes. For example, the electronics systems of the at least one downhole logging tool 124 may be packaged in a first sonde and the telemetry module 126 may be packaged in second sonde. Alternatively, the electronics systems of the at least one downhole logging tool and the telemetry module may both be packaged in the first sonde.

The at least one sonde 202 may be positioned within the downhole tubular 110. As set forth above, to ensure proper functioning of the sonde 202, it may be necessary to stabilize the sonde 202 in a specific location or orientation with respect to the borehole 116 and/or the downhole tubular 110. For example, it may be desirable to maintain the sonde 202 in a centralized position within the borehole 116. The downhole tubular 110 may be positioned within the borehole 116 such that the downhole tubular 110 is substantially centralized within the borehole 116 (e.g., coaxial with the borehole 116). Further, as set forth in greater detail below, the bottom hole assembly 114 may include a centralizer 200 (shown in FIG. 2) configured to stabilize the sonde 202 and/or hold the sonde 202 in a centralized positioned within the downhole tubular 110.

Figure 2:
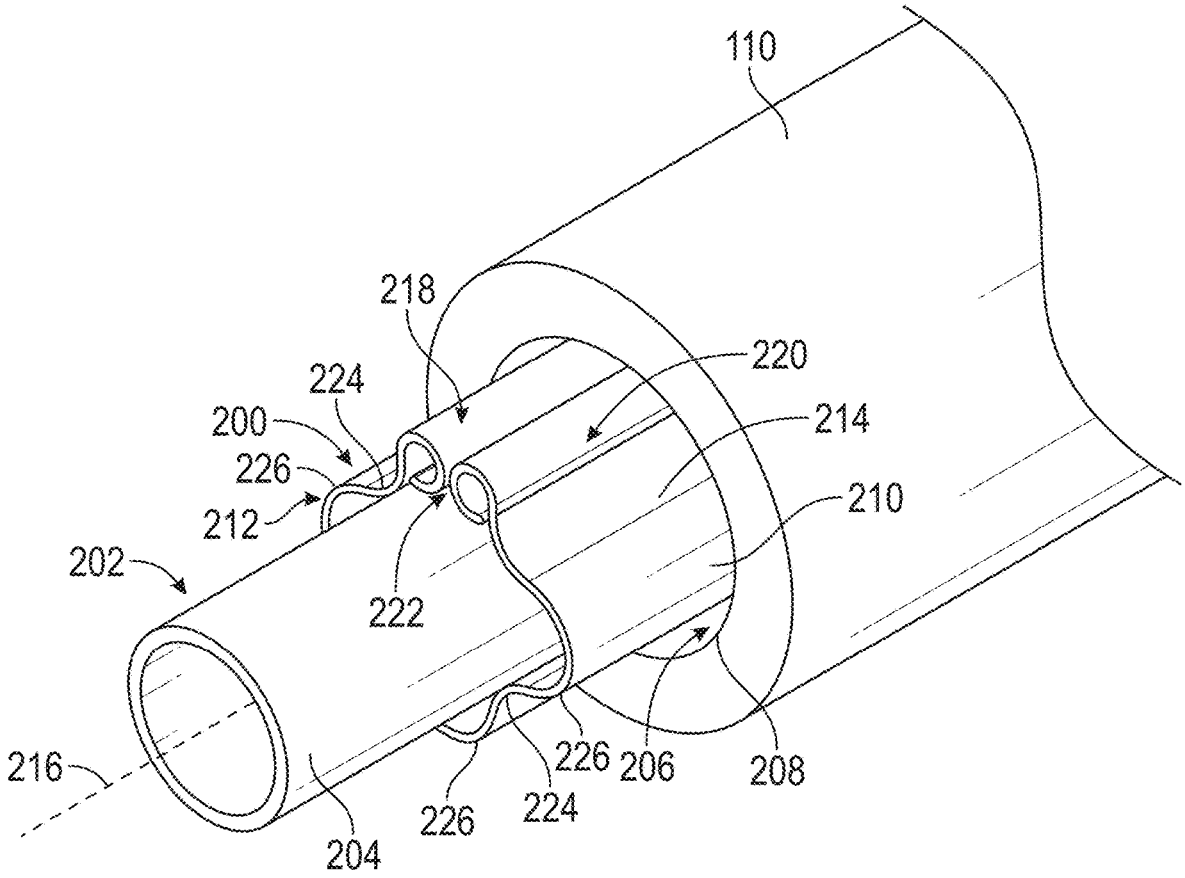
FIG. 2 illustrates a perspective view of a centralizer disposed between a sonde housing and a downhole tubular, in accordance with some embodiments of the present disclosure.

FIG. 2 illustrates a perspective view of a centralizer disposed between a sonde housing and a downhole tubular, in accordance with some embodiments of the present disclosure. As set forth above, the centralizer 200 may be configured to hold the sonde 202 in a centralized position with respect to the downhole tubular 110. Specifically, the sonde 202 may include a sonde housing 204, and the centralizer 200 may be configured to hold the sonde housing 204 in a centralized position with respect to the downhole tubular 110. As such, the centralizer 200 may be disposed in a radial gap 206 formed between a radially inner surface 208 of a downhole tubular 110 and a radially outer surface 210 of the sonde housing 204. The centralizer 200 may be configured to contact both the radially inner surface 208 of the downhole tubular 110 and the radially outer surface 210 of the sonde housing 204 to stabilize and/or centralize the sonde housing 204 within the downhole tubular 110.

Further, the centralizer 200 may include at least one support feature 212. The at least one support feature 212 includes an elongated body portion 214 configured to extend axially along a centralizer axis 216 of the centralizer 200. As illustrated, the at least one support feature 212 may have a uniform cross sectional shape along the length of the at least one support feature 212. Alternatively, the at least one support feature 212 may have a non-uniform cross section. For example, a proximal end and/or distal end of the at least one support feature 212 may be tapered. Moreover, a single support feature 212 may extend along the length of the sonde housing 204. Alternatively, the at least one support feature 212 may include a plurality of support features 212 disposed along the length of the sonde housing 204.

Additionally, the elongated body portion 214 may extend circumferentially about the centralizer axis 216 from a first circumferential end feature 218 to a second circumferential end feature 220, such that the elongated body portion 214 may be configured to extend at least partially about the sonde housing 204. As illustrated, the elongated body portion 214 may substantially extend about the circumference of the sonde housing 204. However, the first circumferential end feature 218 and the second circumferential end feature 220 may be angularly offset from each other such that a support gap 222 is formed between the first circumferential end feature 218 and the second circumferential end feature 220. Having the support gap 222 may reduce installation difficulty for the centralizer 200. In particular, during installation, the at least one support feature 212 may be able to elastically deflect such that the first circumferential end feature 218 and the second circumferential end feature 220 move toward each other, which may temporarily reduce the diameter of the at least one support feature 212 and allow the at least one support feature 212 to more easily slide along the downhole tubular 110.

Moreover, as illustrated, the elongated body portion 214 may be corrugated with radially inward extending portions 224 and radially outward extending portions 226 alternating along the elongated body portion 214 between the first circumferential end feature 218 and the second circumferential end feature 220. The radially inward extending portions 224 are configured to contact the sonde housing 204 and the radially outward extending portions 226 are configured to contact the downhole tubular 110. Such contact may stabilize and/or centralize the sonde housing 204 within the downhole tubular 110.

Figure 3:
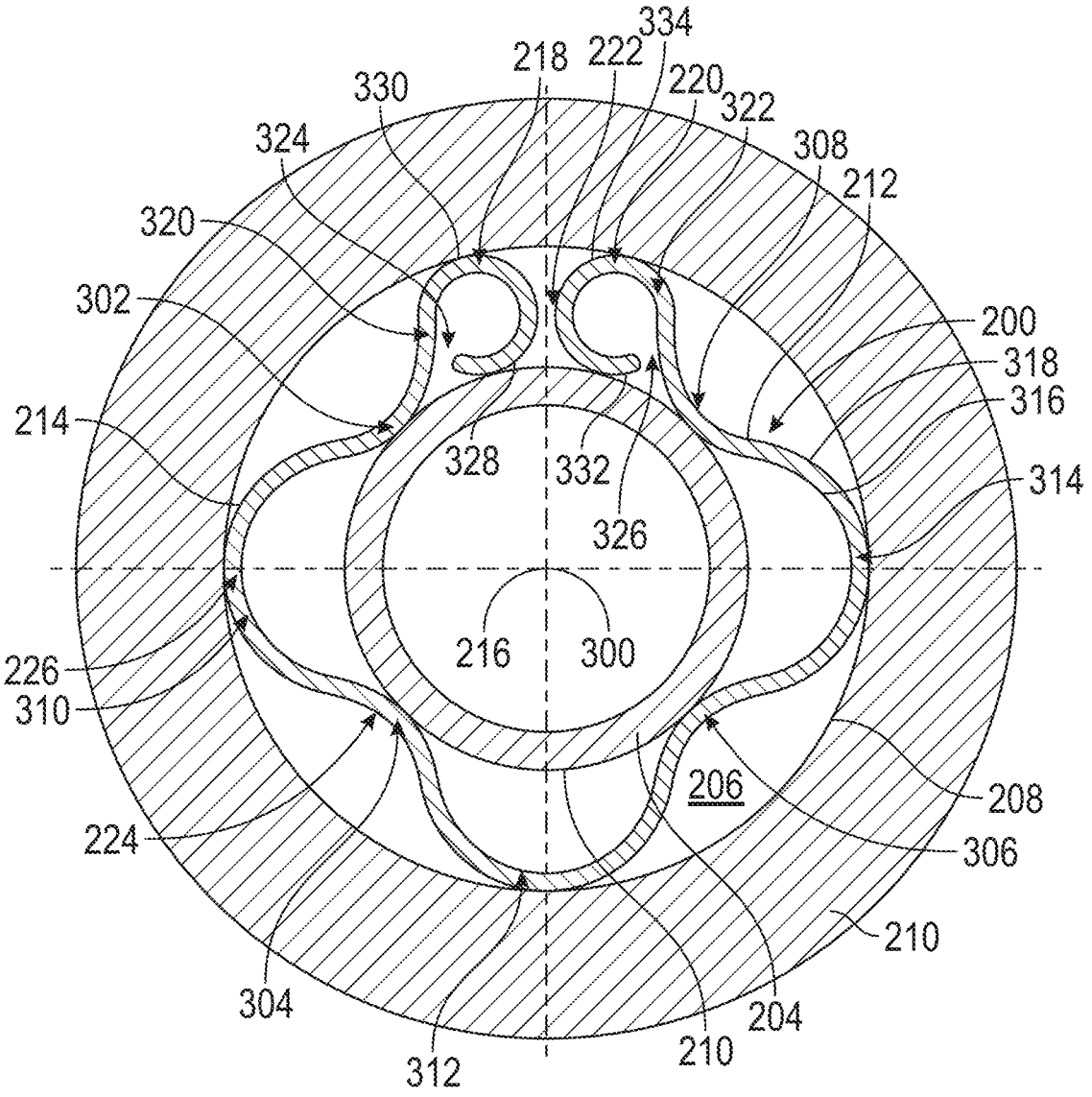
FIG. 3 illustrates a cross-sectional view of a support feature of a centralizer, in accordance with some embodiments of the present disclosure.

FIG. 3 illustrates a cross-sectional view of a support feature of a centralizer, in accordance with some embodiments of the present disclosure. As set forth above, the centralizer 200 includes the at least one support feature 212 disposed in the radial gap 206 formed between the radially inner surface 208 of the downhole tubular 110 and the radially outer surface 210 of the sonde housing 204 to stabilize and/or centralize the sonde housing 204 within the downhole tubular 110. As illustrated, the centralizer axis 216 of the centralizer 200 may be coaxial with a central axis 300 of the downhole tubular 110 such that the centralizer 200 may hold the sonde housing 204 in a centralized position with respect to the downhole tubular 110. Alternatively, the centralizer axis 216 may be offset from the central axis 300 of the downhole tubular 110 (not shown).

Regarding the position of the centralizer axis 216, as set forth above, the at least one support feature 212 may have a uniform cross sectional shape along the length of the at least one support feature 212. As such, the centralizer axis 216 may be defined as extending axially from the center of a reference circle bounded by the cross-sectional shape of the radially inward extending portions 224 of the elongated body portion 214 of the at least one support feature 212. As the radially inward extending portions 224 are in contact with the radially outer surface 210 of the sonde housing 204, the reference circle bounded by the cross-sectional shape of the radially inward extending portions 224 may match a cross-sectional shape of the radially outer surface 210 of the sonde housing 204.

Moreover, as set forth above, the at least one support feature 212 includes the elongated body portion 214 extending axially along the centralizer axis 216 and extending circumferentially about the centralizer axis 216 from the first circumferential end feature 218 to the second circumferential end feature 220. The at least one support feature 212 may extend between three hundred and forty degrees and three hundred and sixty degrees about the centralizer axis 216. That is, a combination of the first circumferential end feature 218, the elongated body portion 214, and the second circumferential end feature 220, may extend between three hundred and forty degrees and three hundred and sixty degrees about the centralizer axis 216. For example, as illustrated, the at least one support feature 212 extends about three hundred and fifty-eight degrees about the centralizer axis 216 such that a two degree support gap 222 is formed between the first circumferential end feature 218 and the second circumferential end feature 220. As set forth above, having the support gap 222 may improve elastic deflection of the at least one support feature 212 during installation.

Further, the elongated body portion 214 may be corrugated with the radially inward extending portions 224 and the radially outward extending portions 226 alternating along the elongated body portion 214 with respect to a circumferential direction between the first circumferential end feature 218 and the second circumferential end feature 220. The elongated body portion 214 may include any suitable pitch. For example, the elongated body portion 214 may include a higher pitch such that the elongated body portion 214 may include more radially inward extending portions 224 and radially outward extending portions 226 than an elongated body portion 214 with lower pitch. As illustrated, the elongated body portion 214 may include four radially inward extending portions (e.g., a first radially inward extending portion 302, a second radially inward extending portion 304, a third radially inward extending portion 306, and a fourth radially inward extending portion 308), as well as three radially outward extending portions (e.g., a first radially outward extending portion 310, a second radially outward extending portion 312, and a third radially outward extending portion 314). However, as set forth above, the elongated body portion 214 may include any suitable number of radially inward extending portions 224 and radially outward extending portions 226 for contacting the sonde housing 204 and the downhole tubular 110, respectively.

The elongated body portion 214 of the at least one support feature 212 may have a substantially uniform thickness. That is, as illustrated, a distance between a radially inner body surface 316 of the elongated body portion 214 and a radially outer body surface 318 of the elongated body portion 214 may be constant along the elongated body portion 214 between the first circumferential end feature 218 and the second circumferential end feature 220. Further, the thickness of the at least one support feature 212 may be uniform along the centralizer axis 216 as well. Moreover, a magnitude of the thickness of the elongated body portion 214 may be based at least in part on a size of the radial gap 206 formed between the radially outer surface 210 of the sonde housing 204 and the radially inner surface 208 of the downhole tubular 110. In particular, the thickness of the elongated body portion 214 of the at least one support feature 212 may be between 5-30% of the thickness of the radial gap 206 formed between the radially inner surface 208 of the downhole tubular 110 and the radially outer surface 210 of the sonde housing 204. An elongated body portion 214 with a thickness greater than 30% of the thickness of the radial gap 206 may hinder flow through the downhole tubular 110 more than an acceptable amount for operating conditions.

Moreover, the first circumferential end feature 218 may include a first end loop 320 and the second circumferential end feature 220 may include a second end loop 322. At least one of the first end loop 320 and the second end loop 322 may include an open loop. As illustrated, both the first end loop 320 and the second end loop 322 include open loops having respective slots (e.g., a first slot 324 and a second slot 326) extending through the corresponding first end loop 320 and the second end loop 322. The first slot 324 and the second slot 326 may each extend axially along the length of the at least one support feature 212. Having the respective slots 324, 326 may benefit installation by allowing the first end loop 320 and the second end loop 322 to deflect during installation.

Further, the first end loop 320 and the second end loop 322 may be configured to assist the radially inward extending portions 224 and the radially outward extending portions 226 of the elongated body portion 214 in stabilizing and/or centralizing the sonde housing 204 with respect to the downhole tubular 110. For example, as illustrated, a first radially inner loop portion 328 of the first end loop 320 may contact the radially outer surface 210 of the sonde housing 204 and a first radially outer loop portion 330 of the first end loop 320 is configured to contact the radially inner surface 208 of the downhole tubular 110. Further, a second radially inner loop portion 332 of the second end loop 322 may contact the radially outer surface 210 of the sonde housing 204 and a second radially outer loop portion 334 of the second end loop 322 is configured to contact the radially inner surface 208 of the downhole tubular 110. Such contact from the first end loop 320 and the second end loop 322 may help stabilize and/or centralize the sonde housing 204 with respect to the downhole tubular 110.

Figure 4:
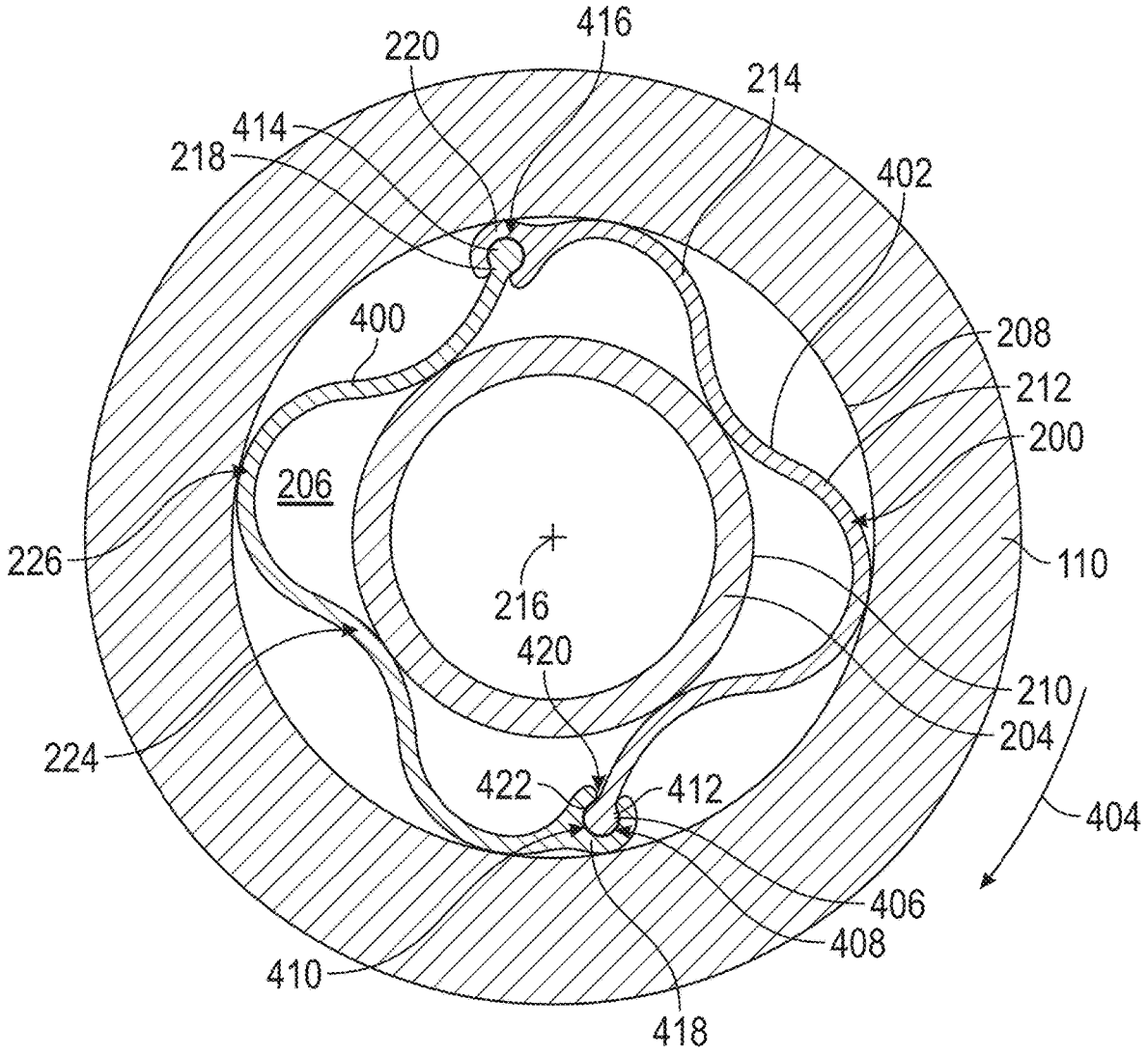
FIG. 4 illustrates a cross-sectional view of a first support feature interlocked with a second support feature, in accordance with some embodiments of the present disclosure.

FIG. 4 illustrates a cross-sectional view of a first support feature interlocked with a second support feature, in accordance with some embodiments of the present disclosure. As set forth above, the centralizer 200 includes the at least one support feature 212 disposed in the radial gap 206 formed between the radially inner surface 208 of the downhole tubular 110 and the radially outer surface 210 of the sonde housing 204 to stabilize and/or centralize the sonde housing 204 within the downhole tubular 110. For example, as illustrated, the centralizer 200 may include at least two support features (e.g., a first support feature 400 and a second support feature 402) configured to interlock to form the centralizer 200 about the circumference of the sonde housing 204.

Each support feature 212 of the at least two support features may include the elongated body portion 214 extending axially along the centralizer axis 216 and extending circumferentially about the centralizer axis 216 from the first circumferential end feature 218 to the second circumferential end feature 220. The elongated body portion 214 may be corrugated about the elongated body portion 214 in the circumferential direction 404. That is, the elongated body portion 214 may include radially inward extending portions 224 and radially outward extending portions 226 that alternate about the elongated body portion 214. Further, as set forth above, the elongated body portion 214 may include a uniform thickness. Moreover, each support feature 212 of the at least two support features (e.g., the first support feature 400 and the second support feature 402) may extend between one hundred and seventy degrees and one hundred and ninety degrees about the centralizer axis 216. As set forth in greater detail below, the first support feature 400 and the second support feature 402 may be interlocked such that a combination of the first support feature 400 and the second support feature 402 may stabilize and/or centralize the sonde housing 204 within the downhole tubular 110.

Each support feature 212 of the at least two support features may include the first circumferential end feature 218 and the second circumferential end feature 220. The first circumferential end feature 218 includes a connection feature 406 and the second circumferential end feature 220 includes a retainer channel 408 configured to receive a corresponding connection feature 406. For example, as illustrated, a first retainer channel 410 of the first support feature 400 may be configured to interlock with a second connection feature 412 of the second support feature 402 and a first connection feature 414 of the first support feature 400 may be configured to interlock with a second retainer channel 416 of the second support feature 402.

As illustrated, the second circumferential end feature 220 may include a retainer feature 418 with the retainer channel 408 extending axially through the retainer feature 418. Further, the retainer feature 418 may include a clearance gap 420 such that a portion of the first circumferential end feature 218 and/or the elongated body portion 214 of a corresponding support feature 212 may extend through the clearance gap 420. Indeed, the retainer feature 418 may include a socket shaped cross-section with a diameter of the retainer channel 408 being larger than the clearance gap 420.

Further, the connection feature 406 of the first circumferential end feature 218 may be thicker than the elongated body portion 214 and extend at least partially along the length of the elongated body portion 214. For example, the connection feature 406 may include a first enlarged portion extending axially along the elongated body portion 214 from a proximal end of the elongated body portion 214, a second enlarged portion extending axially along the elongated body portion 214 from a distal end of the elongated body portion 214, and a central gap between the first enlarged portion and the second enlarged portion. Alternatively, the connection feature 406 may extend along the entire length of the elongated body portion 214.

Additionally, the connection feature 406 may be thicker than the clearance gap 420 such contact between the connection feature 406 and an inner channel surface 422 of the retainer channel 408 proximate the clearance gap 420 may hold the connection feature 406 within the retainer channel 408. Further, as illustrated, the connection feature 406 may include a circular shaped cross-section corresponding to the shape of the retainer channel 408. That is, the circular shaped cross-section of the connection feature 406 may have a diameter that is substantially similar to the diameter of the retainer channel 408. However, the diameter of the retainer channel 408 may be larger than the diameter of the circular shaped cross-section of the connection feature 406 such that the connection feature 406 may be inserted into the retainer channel 408.

Figure 5:
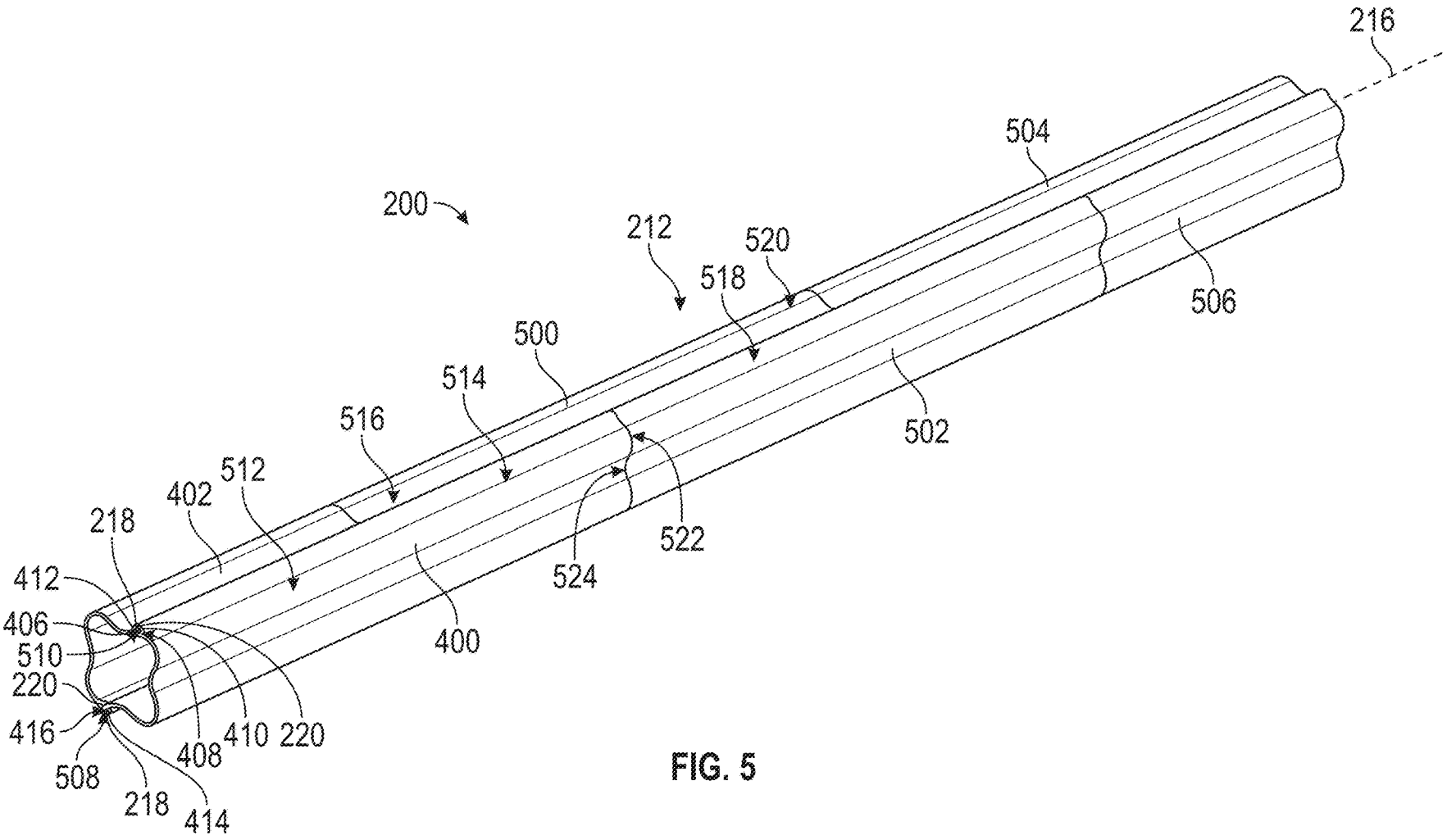
FIG. 5 illustrates a perspective view of a centralizer having a plurality of support features interlocked to extend a length of the centralizer, in accordance with some embodiments of the present disclosure

FIG. 5 illustrates a perspective view of a centralizer having a plurality of support features interlocked to extend a length of the centralizer, in accordance with some embodiments of the present disclosure. As illustrated, the plurality of support features 212 may include six individual support features (e.g., the first support feature 400, the second support feature 402, a third support feature 500, a fourth support feature 502, a fifth support feature 504, and a sixth support feature 506). However, the plurality of support features 212 may include any suitable number of support features. Moreover, each support feature of the plurality of support features 212 may include the first circumferential end feature 218 and the second circumferential end feature 220. As illustrated, the first circumferential end feature 218 may include the connection feature 406 and the second circumferential end feature 220 may include the retainer channel 408 configured to receive a corresponding connection feature 406.

For example, as illustrated, the first retainer channel 410 of the first support feature 400 may be configured to interlock with the second connection feature 412 of the second support feature 402 and the first connection feature 414 of the first support feature 400 may be configured to interlock with the second retainer channel 416 of the second support feature 402. In particular, the first support feature 400 may be interlocked with the second support feature 402 via sliding a lower end of the first connection feature 414 into an upper end 508 of the second retainer channel 416 while simultaneously sliding a lower end of the first retainer channel 410 over an upper end 510 of the second connection feature 412. With the lower end of the first support feature 400 interlocked with the upper end of the second support feature 402, the first support feature 400 may continue to slide with respect to the second support feature 402 to a desired axial position.

Moreover, respective axial lengths of each support feature of the plurality of support features 212 may vary. For example, a first axial length of the first support feature 400 may be greater than a second axial length of the second support feature 402. Having support features with varied lengths may allow the support features 212 to be offset along the centralizer axis 216, such that the support features 212 may be connected along the centralizer axis 216 via only circumferential interfaces (e.g., interlocking the respective connection features with corresponding retainer channels).

Further, as illustrated, the first support feature 400 may be interlocked with the second support feature 402. However, the first support feature 400 may have a greater axial length than the second support feature 402. As such, a first proximal portion 512 of the first support feature 400 may interlocked with the second support feature 402, and a first distal portion 514 of the first support feature 400 may be interlocked with a third proximal portion 516 of the third support feature 500. Further, a fourth proximal portion 518 of a fourth support feature 502 may be interlocked with a third distal portion 520 of the third support feature 500. As illustrated, a fourth proximal end 522 of the fourth support feature 502 may be positioned adjacent a first distal end 524 of the first support feature 400. The fourth proximal end 522 may be anchored directly to the first distal end 524. However, as illustrated, the first distal end 524 and the fourth proximal end 522 may instead be held adjacent to each other via the respective interlockings of the first support feature 400 to the third proximal portion 516 of the third support feature 500 and the fourth support feature 502 to the third distal portion 520 of the third support feature 500. Indeed, the respective connection features 406 and corresponding retainer channels 408 may be sized and shaped with respect to each other such that friction between the connection features 406 and the retainer channels 408 may at least partially restrain axial movement of the support features 212 with respect to each other after installation.

Figure 6:
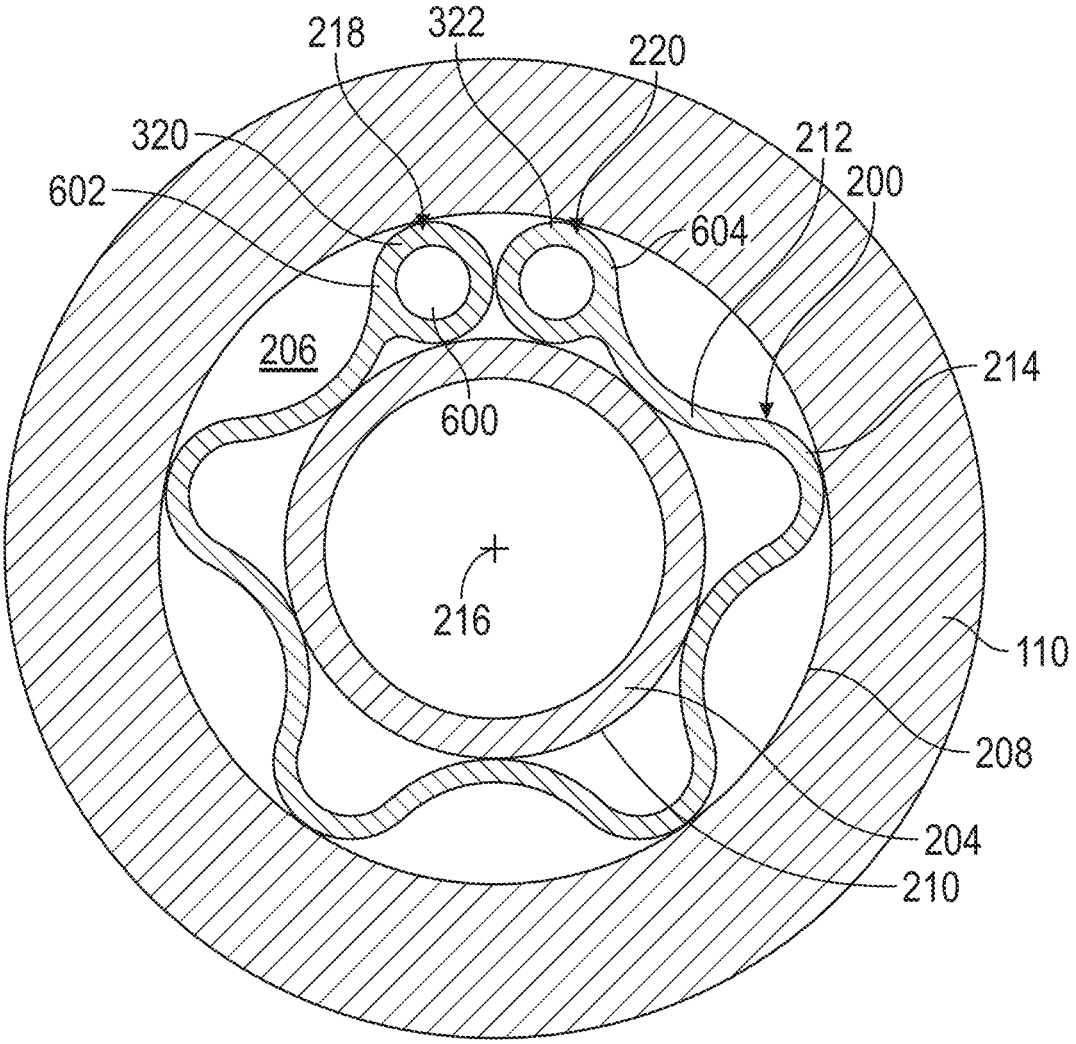
FIG. 6 illustrates a cross-sectional view of a support feature of a centralizer having closed loop circumferential end features, in accordance with some embodiments of the present disclosure.

FIG. 6 illustrates a cross-sectional view of a support feature of a centralizer having closed loop circumferential end features, in accordance with some embodiments of the present disclosure. As set forth above, the centralizer 200 may include the at least one support feature 212 disposed in the radial gap 206 formed between the radially inner surface 208 of the downhole tubular 110 and the radially outer surface 210 of the sonde housing 204 to stabilize and/or centralize the sonde housing 204 within the downhole tubular 110. The at least one support feature 212 may include the elongated body portion 214 extending axially along the centralizer axis 216 and extending circumferentially about the centralizer axis 216 from the first circumferential end feature 218 to the second circumferential end feature 220.

Further, the first circumferential end feature 218 may include the first end loop 320 and the second circumferential end feature 220 may include the second end loop 322. At least one of the first end loop 320 and the second end loop 322 may include a closed loop. For example, the first circumferential end feature 218 may include a substantially loop or ring shaped cross-section that extends axially along the length of the at least one support feature 212. As such, the first end loop 320 may have a tubular shape along the length of the at least one support feature 212. During operation, a hollow center 600 of the first end loop may permit fluid flow through the first end loop 320 along the at least one support feature 212.

As illustrated, the first end loop 320 and the second end loop 322 may be closed loops (e.g., a first closed end loop 602 and a second closed end loop 604). Additionally, the at least one support feature 212 may include the elongated body portion 214 extending substantially about the circumference of the sonde housing 204 such that the first end loop 320 and the second end loop 322 may be disposed adjacent to each other. As illustrated, the first end loop 320 may contact the second end loop 322. Alternatively, the first end loop 320 may be angularly offset from the second end loop 322 to form the support gap (shown in FIG. 3).

Figure 7:
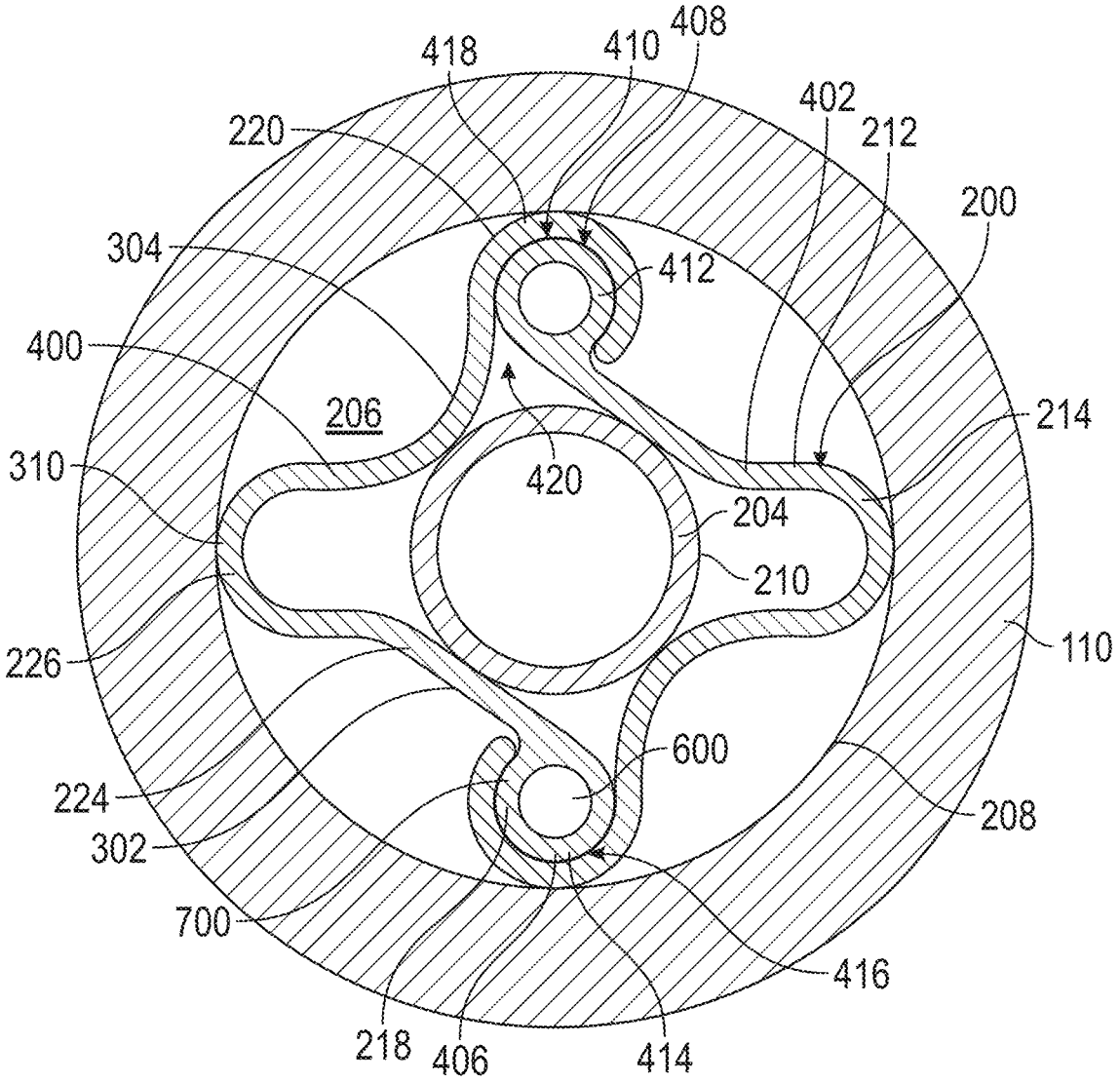
FIG. 7 illustrates a cross-sectional view of a first support feature having a closed loop interlocked with a retainer channel of a second support feature, in accordance with some embodiments of the present disclosure.

FIG. 7 illustrates a cross-sectional view of a first support feature having a closed loop interlocked with a retainer channel of a second support feature, in accordance with some embodiments of the present disclosure. As set forth above, the centralizer 200 may include at least two support features 212 (e.g., the first support feature 400 and the second support feature 402) disposed in the radial gap 206 formed between the radially inner surface 208 of the downhole tubular 110 and the radially outer surface 210 of the sonde housing 204 to stabilize and/or centralize the sonde housing 204 within the downhole tubular 110. As illustrated, the first support feature 400 and the second support feature 402 may be configured to interlock to form the centralizer 200 about the circumference of the sonde housing 204.

Each support feature 212 of the at least two support features may include the elongated body portion 214 extending axially along the centralizer axis 216 and extending circumferentially about the centralizer axis 216 from the first circumferential end feature 218 to the second circumferential end feature 220. The elongated body portion 214 may be corrugated about the elongated body portion 214. That is, the elongated body portion 214 may include radially at least one radially inward extending portion 224 and at least one radially outward extending portion 226 that alternate along the elongated body portion 214 in the circumferential direction. For example, as illustrated, the elongated body portion 214 may include two radially inward extending portions 224 (e.g., the first radially inward extending portion 302 and the second radially inward extending portion 304), as well a single radially outward extending portion (e.g., the first radially outward extending portion 310) disposed between the first radially inward extending portion 302 and the second radially inward extending portion 304. Further, as set forth above, the elongated body portion 214 may include a uniform thickness.

Moreover, each support feature 212 of the at least two support features may include the first circumferential end feature 218 and the second circumferential end feature 220. The first circumferential end feature 218 includes the connection feature 406 and the second circumferential end feature 220 includes the retainer channel 408 configured to receive a corresponding connection feature 406. For example, as illustrated, the first retainer channel 410 of the first support feature 400 may be configured to interlock with the second connection feature 412 of the second support feature 402 and the first connection feature 414 of the first support feature 400 may be configured to interlock with the second retainer channel 416 of the second support feature 402.

As set forth above, the second circumferential end feature 220 may include the retainer feature 418 with the retainer channel 408 extending axially through the retainer feature 418. Further, the retainer feature 418 may include the clearance gap 420 such that a portion of the first circumferential end feature 218 and/or the elongated body portion 214 of a corresponding support feature 212 may extend through the clearance gap 420. For example, as illustrated, a portion of the elongated body portion 214 connected to the connection feature 406 may extend through the clearance gap 420. Further, as set forth above, the cross-section of the retainer feature 418 may be socket shaped with a diameter of the retainer channel 408 being larger than the clearance gap 420.

The connection feature 406 may include a closed loop (e.g., a closed loop connection feature 700). That is, the closed loop connection feature 700 may include a substantially loop or ring shaped cross-section that extends axially along the length of the at least one support feature 212. As such, the closed loop connection feature 700 may have a tubular shape along the length of the at least one support feature 212. Further, an outer diameter of the closed loop connection feature 700 may be greater than a width of the clearance gap 420 of the retainer feature 418 such that contact between the closed loop connection feature 700 and the inner channel surface 422 of the retainer channel 408 proximate the clearance gap 420 may hold the closed loop connection feature 700 within the retainer channel 408.

Additionally, the outer diameter of the closed loop connection feature 700 may be substantially similar to the diameter of the retainer channel 408. However, the diameter of the retainer channel 408 may be larger than the outer diameter of the closed loop connection feature 700 such that the outer diameter of the closed loop connection feature 700 may be inserted into the retainer channel 408 during installation. Moreover, during operation, the hollow center 600 of the closed loop connection feature 700 may permit fluid flow through the closed loop connection feature 700 along the at least one support feature 212.

Figure 8B:
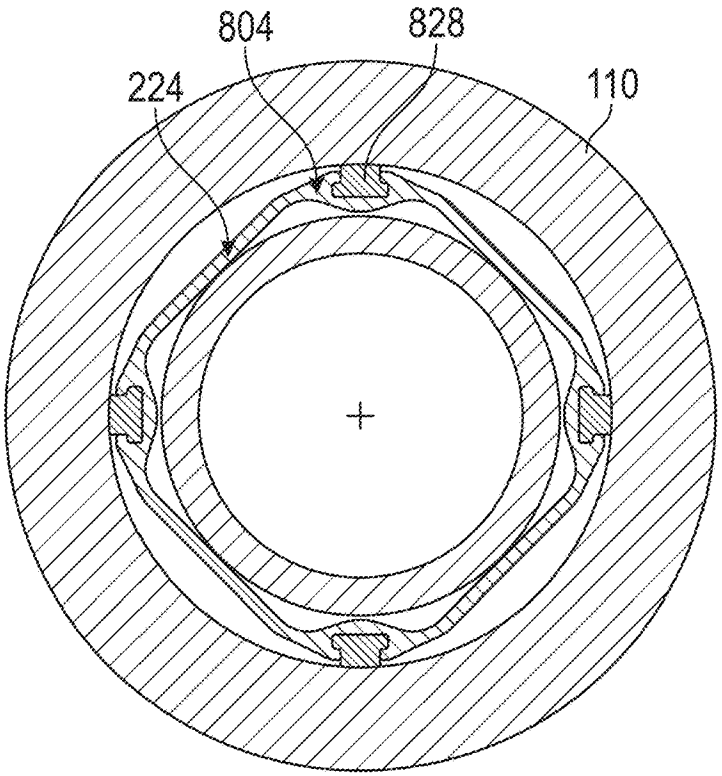
FIGS. 8A-B illustrate respective cross-sectional views of a centralizer having an insert frame and a plurality of support inserts secured to the insert frame, in accordance with some embodiments of the present disclosure.
Figure 8A:
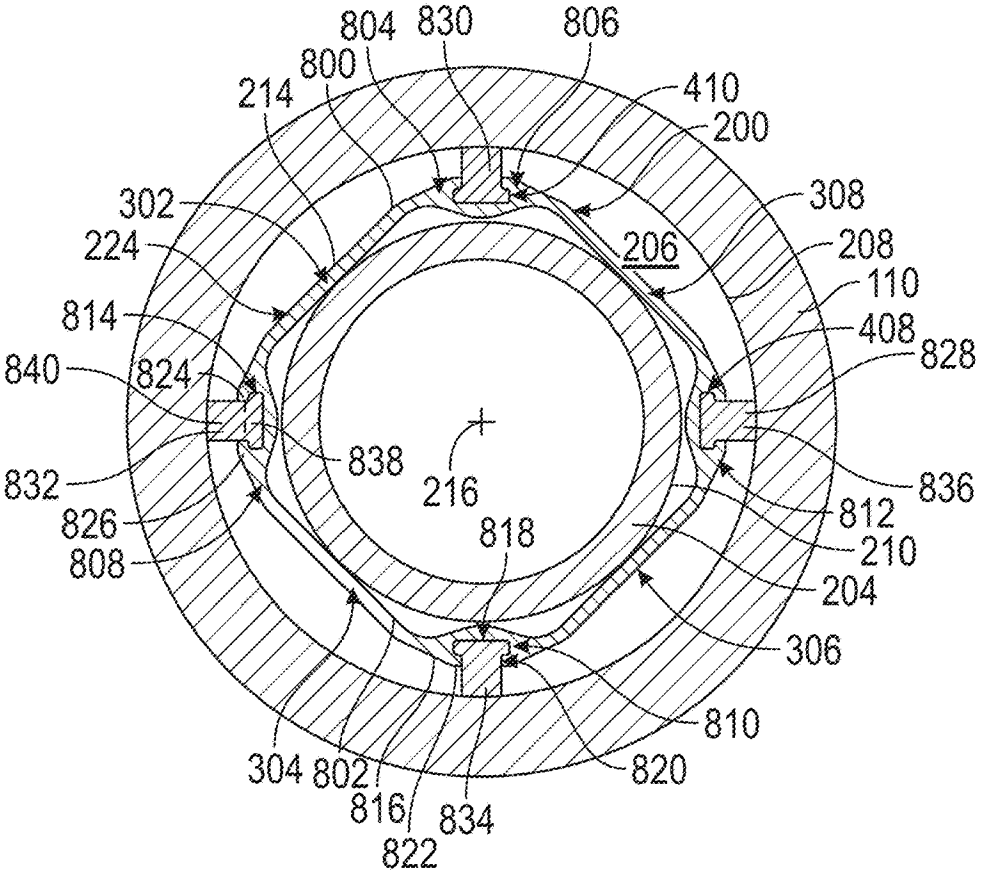

FIGS. 8A-B illustrate respective cross-sectional views of a centralizer having an insert frame and a plurality of support inserts secured to the insert frame, in accordance with some embodiments of the present disclosure. As illustrated in FIG. 8A, the centralizer 200 is disposed in the radial gap 206 formed between the radially inner surface 208 of the downhole tubular 110 and the radially outer surface 210 of the sonde housing 204 to stabilize and/or centralize the sonde housing 204 within the downhole tubular 110.

As illustrated, the centralizer 200 may include an insert frame 800 with an elongated body portion 214 configured to extend axially along a centralizer axis 216 and extend circumferentially about the centralizer axis 216. Further, the elongated body portion 214 is configured to extend about the sonde housing 204. At least a portion of a radially inner frame surface 802 of the insert frame 800 is configured to contact the radially outer surface 210 of the sonde housing 204. In particular, the insert frame 800 may include radially inward extending portions 224 (e.g., a first radially inward extending portion 302, a second radially inward extending portion 304, a third radially inward extending portion 306, and a fourth radially inward extending portion 308) positioned between retainer portions 804 (e.g., a first retainer portion 806, a second retainer portion 808, a third retainer portion 810, and a fourth retainer portion 812) of the insert frame 800. Respective radially inner frame surfaces 802 of the radially inward extending portions 224 may contact the radially outer surface 210 of the sonde housing 204.

Further, the insert frame 800 may include a plurality of retainer channels 814 formed in a radially outer frame surface 816 of the insert frame 800. In particular, each retainer channel of the plurality of retainer channels 814 may be formed in a respective radially outer frame surface 816 of a corresponding retainer portion 804 and extend axially along the length of the insert frame 800. For example, a first retainer channel 410 may formed in the radially outer frame surface 816 of the first retainer portion 806 and extend axially along the length of the insert frame 800. Additionally, each retainer channel 408 may include a main channel 818 and a gap portion 820. The gap portion 820 may extend radially inward from the radially outer frame surface 816 of the corresponding retainer portion 804 to the main channel 818. Further, at least a portion of the main channel 818 may be wider than the gap portion 820. Indeed, the gap portion 820 may be formed between at least one retention lip 822 of the corresponding retainer portion 804 of the insert frame 800. As illustrated, the gap portion 820 may be formed between a first retention lip 824 and a second retention lip 826.

Moreover, the centralizer 200 may include a plurality of support inserts 828 (e.g., a first support insert 830, a second support insert 832, a third support insert 834, and a fourth support insert 836). As illustrated, each support insert of the plurality of support inserts 828 may be secured within a corresponding retainer channel of the plurality of retainer channels 814. For example, the first support insert 830 may be secured within the first retainer channel 410.

Each support insert 828 may include a connector portion 838 and a radial support portion 840. The connector portion 838 may be inserted into the main channel 818 of the retainer channel 408 via an axial end of the insert. The radial support portion 840 may be configured to extend radially outward from the connector portion 838 and through the gap portion 820. A radial length of the radial support portion 840 may be based at least in part on an inner diameter of the downhole tubular 110. Indeed, the radial support portion 840 of the support insert 828 is configured to extend radially outward from the corresponding retainer channel 408 to contact the radially inner surface 208 of a downhole tubular 110. As such, the radial length of the radial support portion 840 may be larger for downhole tubulars 110 with larger inner diameters, and, as shown in FIG. 8B, the radial length of the radial support portion 840 may be smaller for downhole tubulars 110 with smaller inner diameters.

Additionally, the connector portion 838 of the support insert 828 may have a larger width than the width of the gap portion 820 such that the retainer channel 408 may restrain the support insert 828 from exiting the retainer channel 408 via the gap portion 820. In particular, contact between the at least retention lip 822 and the connector portion 838 may restrain the support insert 828 from exiting the retainer channel 408. Further, the connector portion 838 may include a substantially similar cross sectional shape to the cross sectional shape of the retainer channel 408 to reduce pivoting and/or other movement of the connector portion 838 of the support insert 828 with respect to the retainer channel 408.

Moreover, as illustrated, contact between the plurality of support inserts 828 and the downhole tubular 110 and contact between the insert frame 800 and the sonde housing 204 may be configured to stabilize the sonde housing 204 and/or hold the sonde housing 204 in a centralized position with respect to the downhole tubular 110.

Figure 9:
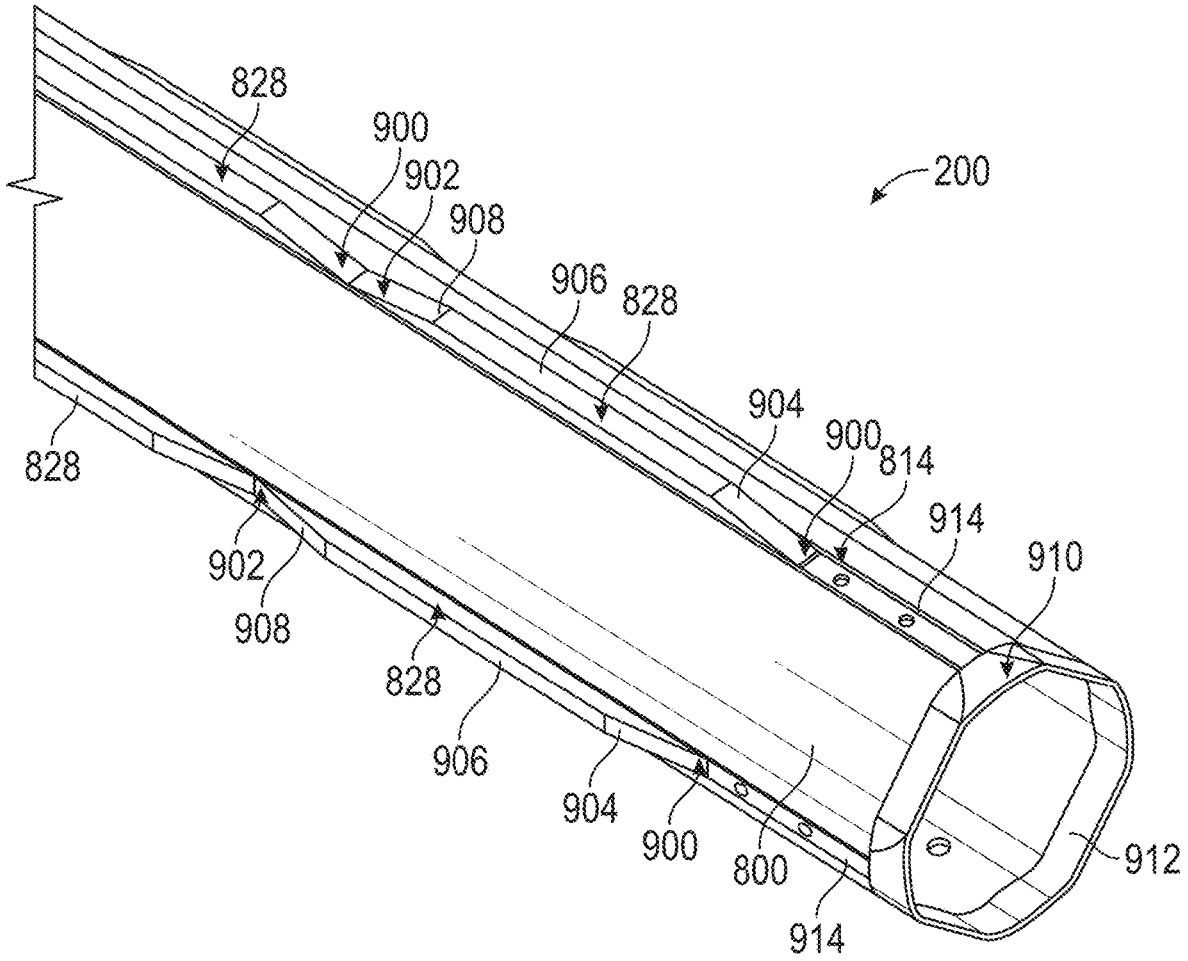
FIG. 9 illustrates a perspective view of a centralizer having tapered support inserts, in accordance with some embodiments of the present disclosure.

FIG. 9 illustrates a perspective view of a centralizer having tapered support inserts, in accordance with some embodiments of the present disclosure. The centralizer 200 may include a plurality of support inserts 828 secured to the insert frame 800. Further, at least one support insert 828 of the plurality of inserts may include a variable radial height along an axial length of the support insert 828. That is, the at least one support insert 828 may be tapered. For example, as illustrated, the at least one support insert 828 may be tapered at both a proximal insert end 900 and a distal insert end 902 of the at least one support insert 828. The at least one support insert 828 may include a proximal insert portion 904, a middle insert portion 906, and a distal insert portion 908, and the radial height of the middle insert portion 906 may be greater than the respective radial heights of the proximal insert portion 904 and/or the distal insert portion 908. Indeed, as illustrated, the radial height of the at least one support insert 828 may taper down from the middle insert portion 906 toward the respective proximal insert end 900 and distal insert end 902 of the at least one support insert 828. Alternatively, the at least one support insert 828 may have a stepped radial height. Further, the proximal insert portion 904 and/or the middle insert portion 906 may have a greater radial height than the middle insert portion 906.

Moreover, the centralizer 200 may further include at least one centralizer insert cap 910 securable to an axial end of the insert frame 800. As illustrated, the centralizer 200 may include a proximal centralizer insert cap 910 secured at the proximal insert end 900 of the centralizer 200. The centralizer 200 may further include a distal centralizer insert cap secured at the distal end of the centralizer (not shown). Further, the at least one centralizer insert cap 910 may be configured to retain the plurality of support inserts 828 within the plurality of retainer channels 814. That is, the at least one centralizer insert cap 910 may be configured to block respective axial ends of each retainer channel of the plurality of retainer channels 814 such that the corresponding support inserts of the plurality of support inserts 828 are blocked from sliding through respective axial ends of the retainer channels 814.

As illustrated, the at least one centralizer insert cap 910 may include a ring portion 912 and a plurality of blocking features 914 extending axially outward from the ring portion 912. Each blocking feature 914 of the plurality of blocking features 914 may be aligned with a corresponding retainer channel 408. Each blocking feature 914 may be configured to insert into the corresponding retainer channel 408 to block the respective axial ends of the retainer channels 814. However, the at least one centralizer insert cap 910 may include any suitable assembly for blocking the respective axial ends of the retainer channels 814.

Accordingly, the present disclosure may provide a centralizer having at least one support feature extending at least partially about a sonde housing to hold the sonde housing in a centralized position with respect to a downhole tubular. The systems and methods may include any of the various features disclosed herein, including one or more of the following statements.

Statement 1. A system, comprising: a centralizer configured to be disposed in a radial gap formed between a radially inner surface of a downhole tubular and a radially outer surface of a sonde housing, wherein the centralizer includes at least one support feature, wherein the at least one support feature comprises: a first circumferential end feature; a second circumferential end feature; and an elongated body portion configured to extend axially along a centralizer axis and extend circumferentially about the centralizer axis from the first circumferential end feature to the second circumferential end feature, wherein the elongated body portion is corrugated with radially inward extending portions and radially outward extending portions alternating along the elongated body portion between the first circumferential end feature and the second circumferential end feature, and wherein the radially inward extending portions are configured to contact the sonde housing and the radially outward extending portions are configured to contact the downhole tubular to hold the sonde housing in a centralized position with respect to the downhole tubular.

Statement 2. The system of statement 1, wherein the first circumferential end feature includes a first end loop, wherein the second circumferential end feature includes a second end loop, and wherein the first end loop is disposed adjacent the second end loop.

Statement 3. The system of statement 1 or statement 2, wherein at least one of the first end loop and the second end loop includes an open loop, wherein the open loop includes a slot extending axially along a length of the at least one support feature.

Statement 4. The system of statement 1 or statement 2, wherein at least one of the first end loop and the second end loop includes a closed loop.

Statement 5. The system of any preceding statement, wherein a radially inner loop portion of the first end loop is configured to contact the radially outer surface of the sonde housing, and wherein a radially outer loop portion of the first end loop is configured to contact the radially inner surface of the downhole tubular.

Statement 6. The system of any preceding statement, wherein the first circumferential end feature includes a connection feature, wherein at least a portion of the connection feature is thicker than the elongated body portion, and wherein the second circumferential end feature includes a retainer channel.

Statement 7. The system of any preceding statement, wherein the at least one support feature includes a first support feature and a second support feature, wherein a first retainer channel of the first support feature is configured to interlock with a second connection feature of the second support feature and a first connection feature of the first support feature is configured to interlock with a second receiver channel of the second support feature.

Statement 8. The system of any preceding statement, wherein the at least one support feature extends between three hundred and forty degrees and three hundred and sixty degrees about the centralizer axis.

Statement 9. The system of any of statements 1-7, wherein the at least one support feature extends between one hundred and seventy degrees and one hundred and ninety degrees about the centralizer axis.

Statement 10. The system of any preceding statement, wherein the at least one support feature has a uniform cross sectional shape along a length of the at least one support feature.

Statement 11. The system of any preceding statement, wherein the centralizer axis is coaxial with a central axis of the downhole tubular.

Statement 12. The system of any preceding statement, wherein the elongated body portion of the at least one support feature has a uniform thickness.

Statement 13. The system of any preceding statement, further comprising: the downhole tubular; and the sonde housing disposed within a central bore of the downhole tubular, wherein the sonde housing is configured to house electrical components, and wherein the centralizer is disposed within a radial gap formed between the radially outer surface of the sonde housing and the radially inner surface of the downhole tubular.

Statement 14. The system of any preceding statement, wherein a thickness of the elongated body portion of the at least one support feature is between 5-30% of a thickness of the radial gap formed between the radially inner surface of the downhole tubular and the radially outer surface of the sonde housing.

Statement 15. A system, comprising: a centralizer configured to be disposed between a radially inner surface of a downhole tubular and a radially outer surface of a sonde housing, wherein the centralizer includes at least two support features, wherein each support feature comprises: a first circumferential end feature, wherein the first circumferential end feature includes a connection feature; a second circumferential end feature, wherein the second circumferential end feature includes a retainer channel configured to receive a corresponding connection feature; an elongated body portion configured to extend axially along a centralizer axis and extend circumferentially about the centralizer axis from the first circumferential end feature to the second circumferential end feature, wherein the elongated body portion is corrugated with radially inward extending portions and radially outward extending portions alternating along the elongated body portion between the first circumferential end feature and the second circumferential end feature; and wherein a first retainer channel of a first support feature is configured to interlock with a second connection feature of a second support feature and a first connection feature of the first support feature is configured to interlock with a second receiver channel of the second support feature, and wherein the centralizer is configured to hold the sonde housing in a centralized position with respect to the downhole tubular.

Statement 16. The system of statement 15, wherein the first support feature has a first axial length, and the second support feature has a second axial length, wherein the first axial length is greater than the second axial length.

Statement 17. The system of statement 15 or statement 16, wherein a first proximal portion of the first support feature is interlocked with the second support feature, wherein a first distal portion of the first support feature is interlocked with a third proximal portion of a third support feature, and wherein a fourth support feature is interlocked with a third distal portion of the third support feature and positioned adjacent a first distal end of the first support feature.

Statement 18. A system, comprising: a centralizer configured to be disposed in a radial gap formed between a radially inner surface of a downhole tubular and a radially outer surface of a sonde housing, wherein the centralizer comprises: an insert frame with an elongated body portion configured to extend axially along a centralizer axis and extend circumferentially about the centralizer axis, wherein at least a portion of a radially inner frame surface of the insert frame is configured to contact the radially outer surface of the sonde housing, and wherein the insert frame comprises a plurality of retainer channels formed in a radially outer frame surface of the insert frame; and a plurality of support inserts, wherein each support insert of the plurality of support inserts is secured within a corresponding retainer channel of the plurality of retainer channels, wherein each support insert is configured to extend radially outward from the corresponding retainer channel to contact the radially inner surface of the downhole tubular, and wherein contact between the plurality of inserts and the downhole tubular and contact between the insert frame and the sonde housing is configured to hold the sonde housing in a centralized position with respect to the downhole tubular.

Statement 19. The system of statement 18, further comprising at least one centralizer insert cap securable to an axial end of the insert frame, wherein the at least one centralizer insert cap is configured to retain the plurality of support inserts within the plurality of retainer channels.

Statement 20. The system of statement 18 or statement 19, wherein at least one support insert of the plurality of inserts includes a variable radial height along an axial length of the support insert, wherein the at least one support insert includes a proximal insert portion, a middle insert portion, and a distal insert portion, and wherein a radial height of the middle insert portion is greater than the respective radial heights of the proximal insert portion and/or the distal insert portion.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system, comprising:

a centralizer configured to be disposed in a radial gap formed between a radially inner surface of a downhole tubular and a radially outer surface of a sonde housing, wherein the centralizer includes at least one support feature, wherein the at least one support feature comprises:

a first circumferential end feature;

a second circumferential end feature, wherein the first circumferential end feature includes a first end loop, wherein the second circumferential end feature includes a second end loop, and wherein the first end loop is disposed adjacent the second end loop; and an elongated body portion configured to extend axially along a centralizer axis and extend circumferentially about the centralizer axis from the first circumferential end feature to the second circumferential end feature, wherein the elongated body portion is corrugated with radially inward extending portions and radially outward extending portions alternating along the elongated body portion between the first circumferential end feature and the second circumferential end feature, and wherein the radially inward extending portions are configured to contact the sonde housing and the radially outward extending portions are configured to contact the downhole tubular to hold the sonde housing in a centralized position with respect to the downhole tubular, wherein a radially inner loop portion of the first end loop is configured to contact the radially outer surface of the sonde housing, and wherein a radially outer loop portion of the first end loop is configured to contact the radially inner surface of the downhole tubular.

2. The system of claim 1, wherein at least one of the first end loop and the second end loop includes an open loop, wherein the open loop includes a slot extending axially along a length of the at least one support feature.

3. The system of claim 1, wherein at least one of the first end loop and the second end loop includes a closed loop.

4. The system of claim 1, wherein the at least one support feature extends between three hundred and forty degrees and three hundred and sixty degrees about the centralizer axis.

5. The system of claim 1, wherein the at least one support feature has a uniform cross sectional shape along a length of the at least one support feature.

6. The system of claim 1, wherein the centralizer axis is coaxial with a central axis of the downhole tubular.

7. The system of claim 1, wherein the elongated body portion of the at least one support feature has a uniform thickness.

8. The system of claim 1, further comprising:

the downhole tubular; and the sonde housing disposed within a central bore of the downhole tubular, wherein the sonde housing is configured to house electrical components, and wherein the centralizer is disposed within a radial gap formed between the radially outer surface of the sonde housing and the radially inner surface of the downhole tubular.

9. The system of claim 8, wherein a thickness of the elongated body portion of the at least one support feature is between 5-30% of a thickness of the radial gap formed between the radially inner surface of the downhole tubular and the radially outer surface of the sonde housing.

* * * * *